US005775786A

United States Patent [19]

Liebertz

[11] Patent Number: 5,775,786

[45] Date of Patent: Jul. 7, 1998

[54] DRAWER SLIDE

[75] Inventor: Frederick C. Liebertz, Twin Lake, Mich.

[73] Assignee: Haworth, Inc., Holland, Mich.

[21] Appl. No.: 794,867

[22] Filed: Feb. 5, 1997

[51] Int. Cl.[6] ..... A47B 88/04

[52] U.S. Cl. ..... 312/334.8; 312/334.11; 312/351; 312/257.1; 312/333

[58] Field of Search ..... 312/334.8, 333, 312/330.1, 350, 351, 257.1, 263, 334.4, 334.11, 334.44, 334.46; 211/187, 191; 108/106, 110, 193

[56] References Cited

U.S. PATENT DOCUMENTS

| | | | |
|---|---|---|---|
| 2,686,704 | 8/1954 | Wolters | 312/257.1 |
| 3,133,768 | 5/1964 | Klakovich | 312/334.8 X |
| 3,377,115 | 4/1968 | Hansen et al. . | |
| 3,716,284 | 2/1973 | Bogt . | |
| 3,771,849 | 11/1973 | Barber | 312/350 |
| 3,923,347 | 12/1975 | Dean . | |
| 4,183,596 | 1/1980 | Greene et al. | 312/333 |
| 4,469,384 | 9/1984 | Fler et al. | 312/333 |
| 4,872,734 | 10/1989 | Rechberg | 312/333 |
| 4,998,828 | 3/1991 | Hobbs | 312/334.46 |
| 5,433,516 | 7/1995 | Beals et al. | 312/257.1 |
| 5,466,060 | 11/1995 | Hoffman | 312/334.8 |
| 5,470,143 | 11/1995 | Gill | 312/334.4 |
| 5,472,272 | 12/1995 | Hoffman | 312/334.11 |
| 5,507,571 | 4/1996 | Hoffman | 312/334.8 |
| 5,551,775 | 9/1996 | Parvin | 312/334.11 |
| 5,577,821 | 11/1996 | Chu | 312/334.8 X |
| 5,624,171 | 4/1997 | Soja et al. | 312/334.8 |

FOREIGN PATENT DOCUMENTS

| | | | |
|---|---|---|---|
| 583978 | 2/1994 | European Pat. Off. | 312/334.11 |
| 620460 | 3/1949 | United Kingdom | 312/334.11 |

*Primary Examiner*—Laurie K. Cranmer
*Assistant Examiner*—James O. Hansen
*Attorney, Agent, or Firm*—Flynn, Thiel, Boutell & Tanis, P.C.

[57] ABSTRACT

A drawer slide for a drawer-type storage unit allowing a drawer to be horizontally moved from the storage unit to allow access into the interior of the drawer. The drawer slide is vertically symmetrical about a central longitudinal plane perpendicular to the side surfaces of the drawer slide. A cantilevered tongue, loop-like bracket, and latch are vertically symmetrically positioned on a support rail of the drawer slide. The tongue is receivable in a slot in a vertical mounting rail in the storage unit. The bracket is received in an opening of a vertical mounting rail. The latch engages a further slot in a vertical mounting rail to prevent accidental disengagement of the slide rail from the mounting rails. The vertical symmetry of the drawer slide allows the drawer slides to be used on either side of the storage unit with only a front and back orientation.

10 Claims, 7 Drawing Sheets

FIG.5
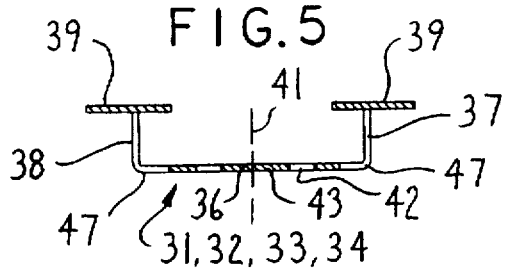
FIG.4
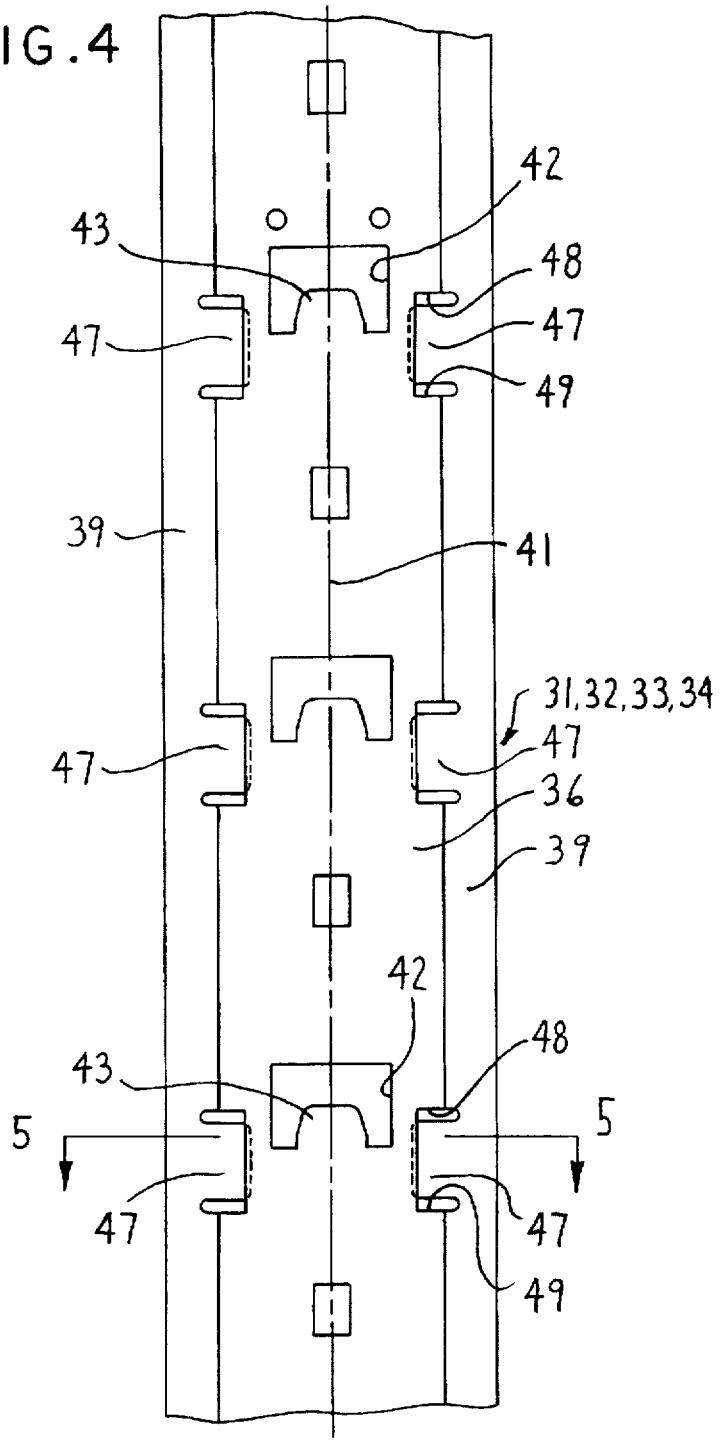
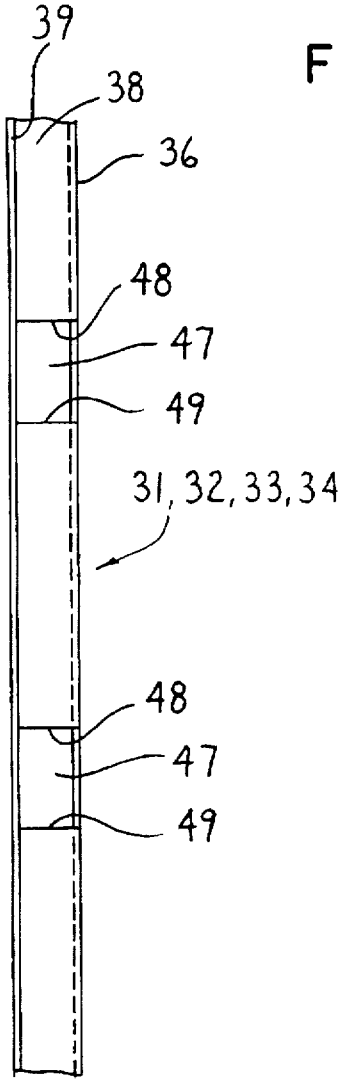
FIG.6

DRAWER SLIDE

FIELD OF THE INVENTION

This invention relates to an improved drawer slide for mounting a drawer within a storage cabinet or housing and, more particularly, to an improved drawer slide unit which is constructed to permit efficient and secure connection of the drawer slide unit to the cabinet side wall without requiring fasteners or the like, and which enables the same drawer slide unit to be used on either the right or left side wall of the cabinet.

BACKGROUND OF THE INVENTION

Drawer type storage units typically employ a generally hollow boxlike housing or cabinet open on a front side thereof, with one or more drawers being horizontally slidably supported within the housing and disposed so that, when in a closed position, the drawer fronts generally occupy and close off the opening defined in the front side of the housing. Each drawer unit is typically horizontally movably supported on the housing by slide units which connect between the side or end walls of the drawer unit, and the adjacent opposed side walls of the housing. The slide units typically include an elongate support rail which is stationarily attached to the respective housing side wall and extends horizontally between the rear and front edges thereof. The support rail in turn mounts thereon a slide rail which connects to the end wall of the drawer unit and is horizontally slidably supported on the support rail. The slide rail, which in many cases is of telescopic construction to extend the stroke or displacement of the drawer unit, is itself longitudinally slidably or movably supported with the support rail, typically through an intermediate roller arrangement.

The construction of conventional drawer slides is such that, in many instances, the support rail is secured to the housing by fasteners such as screws and the like. Such arrangements, however, are undesirable with respect to the time and hence efficiency associated with assembly of the drawer-type storage unit.

In an effort to simplify the construction and specifically the assembly of the storage unit, drawer slides have been developed whereby the support rail attaches to the housing in a manner free of fasteners. While several such drawer slides have been developed, nevertheless most of these prior drawer slides still possess structural or functional features which are considered disadvantageous. For example, in many of these prior drawer slides, the drawer slide possesses structural relationships which define right and left, as well as front and back mounting characteristics so that the pair of drawer slides which mounts each drawer to the housing thus requires distinct right and left drawer slide units, which units are typically identical except for being mirror images of one another. The right and left mounting requirement, and the necessity of manufacturing two separate drawer slides, increases the overall manufacturing cost and complexity, and the assembly complexity.

One prior drawer slide, which is utilized by the Assignee hereof and which is free of securing fasteners, employs an elongate support rail provided with a projection at a rearward end thereof. This projection extends longitudinally rearwardly of the support rail for horizontal insertion into a slot provided in a channel-like rear support which is fixed to and extends vertically along the housing side wall adjacent a rear edge thereof. The support rail also has a downwardly cantilevered prong provided thereon adjacent a front end thereof. This prong is inserted into a slot or opening formed in a channel-like front support which is fixed to the side wall adjacent a front edge thereof. The prong is inserted into the slot by vertically pivoting the support rail downwardly about the rear end to cause supportive engagement between the prong and slot. The support rail also has a detent provided thereon adjacent and spaced vertically above the prong so that, when the prong is fully seated within the slot, the detent snaps under the upper edge of the slot to prevent upward lifting of the support rail. While this arrangement structurally and functionally performs in a satisfactory manner, nevertheless the drawer slide has defined right and left relationships due to the manner in which the prong and detent are formed on the front ends of the support rails, and thus each drawer is supported on a pair of drawer slide units which are defined by distinct right and left slide units. As is believed apparent, this complicates both manufacturing and assembling of the storage unit.

In another prior drawer slide, as also utilized by the Assignee hereof, the support rails are provided with longitudinally rearwardly projecting tongues adjacent the front and rear ends thereof which respectively engage within slots or openings formed in respective front and rear channel supports associated with the housing side wall. The support rail is thus engaged solely by a horizontal longitudinal movement of the support rail relative to the side wall. The front tongue also has a detent aligned therewith so that when the tongues are properly engaged, the detent snaps over and is positioned adjacent an edge of the respective slot to prevent reverse longitudinal movement of the support rail. This support rail, as currently constructed, again possesses structural characteristics which impart distinct right and left relationships, so that the mounting of each drawer requires a pair of slide units defined by distinct right and left slide units. Further, when utilizing an arrangement employing a detent of the type possessed by this slide unit, removal of the support rail from the housing side wall requires insertion of a tool from behind so as to pop or press the detent out of the respective slot, and this is often a difficult or time consuming operation.

In another known but more recently developed drawer slide, the support rail again employs front and rear projections which extend longitudinally rearwardly so that the support rail is mounted on the housing side wall solely by horizontal longitudinal displacement of the support rail so as to effect insertion of the projections into respective front and rear slots or openings. In this support rail, however, the detent provided on the support rail is defined by a longitudinally elongate cantilevered spring which resiliently snaps into a respective slot or opening on the support rail to lock the support rail longitudinally in position only when the support rail is longitudinally positioned so as to be properly seated on the side wall. With this latter arrangement, the elongate cantilevered spring detent performs substantially the same function as the more rigid detent provided on the prior art drawer slide discussed above. This drawer slide employing the spring detent, however, again possesses distinct right and left structural features which are still disadvantageous.

Examples of prior art drawer slides are illustrated by the following U.S. Pat. Nos.: 5,470,143, 3,771,849 and 3,716,284.

It is accordingly an object of this invention to provide an improved drawer slide for a drawer-type storage unit, which drawer slide is mountable in a fastener-free manner, and is free of right/left structural characteristics so that the same drawer slide can be used for securement to either the right side or left side of the storage unit housing.

A further object of the invention is to provide an improved drawer slide, as aforesaid, which cooperates with and is supportingly engaged with and between a pair of vertically elongate support members which are fixed to and extend vertically along the housing side wall adjacent front and rear edges thereof, which support members themselves can be of identical construction.

The drawer slide of the present invention includes a horizontally elongate support rail which at its rearward end is provided with a support tongue or projection which extends longitudinally rearwardly and is engageable within a slot or opening defined in a rear support member which is fixed to and extends vertically along the side wall of the storage unit housing. The support rail adjacent its forward end has a sidewardly-projecting loop-like bracket which defines an opening therebehind which extends vertically therethrough for cooperation with an upwardly projecting prong which is defined on a front upright support member fixed to the respective side wall of the housing. The rear projection of the support rail is first longitudinally horizontally inserted into the slot defined in the rear upright support member, and the front of the support member is then pivoted downwardly to cause the prong to project upwardly into the bracket, with the bracket seating against a shoulder or bottom wall of the prong. The support rail also has a resilient elongate detent or latch which abuts the front support member and, when the bracket is downwardly seated against the prong, snaps into an opening formed in the front support member to resist upward displacement of the front end of the support rail. The support rail is preferably vertically symmetrical about its longitudinal axis so that the same support rail can be vertically rotated about its longitudinal axis for engagement with either the right side wall or the left side wall of the housing. The support rail in turn movably mounts an elongate slide rail which attaches to the end wall of the drawer, and this slide rail is preferably provided with vertically symmetrical attaching structure so as to be useable as either a right side or left side unit.

Other objects and purposes of the invention will be apparent to persons familiar with structures of this general type upon reading the following specification and inspecting the accompanying drawings.

BRIEF DESCRIPTION OF THE DRAWINGS

FIG. 4 is an enlarged partial view of an upright support member.

FIG. 5 is a cross sectional view of the upright support member taken along line 5—5 in FIG. 4.

FIG. 6 is a view similar to FIG. 4 but rotated 90° to show a side view thereof.

Figure 1:
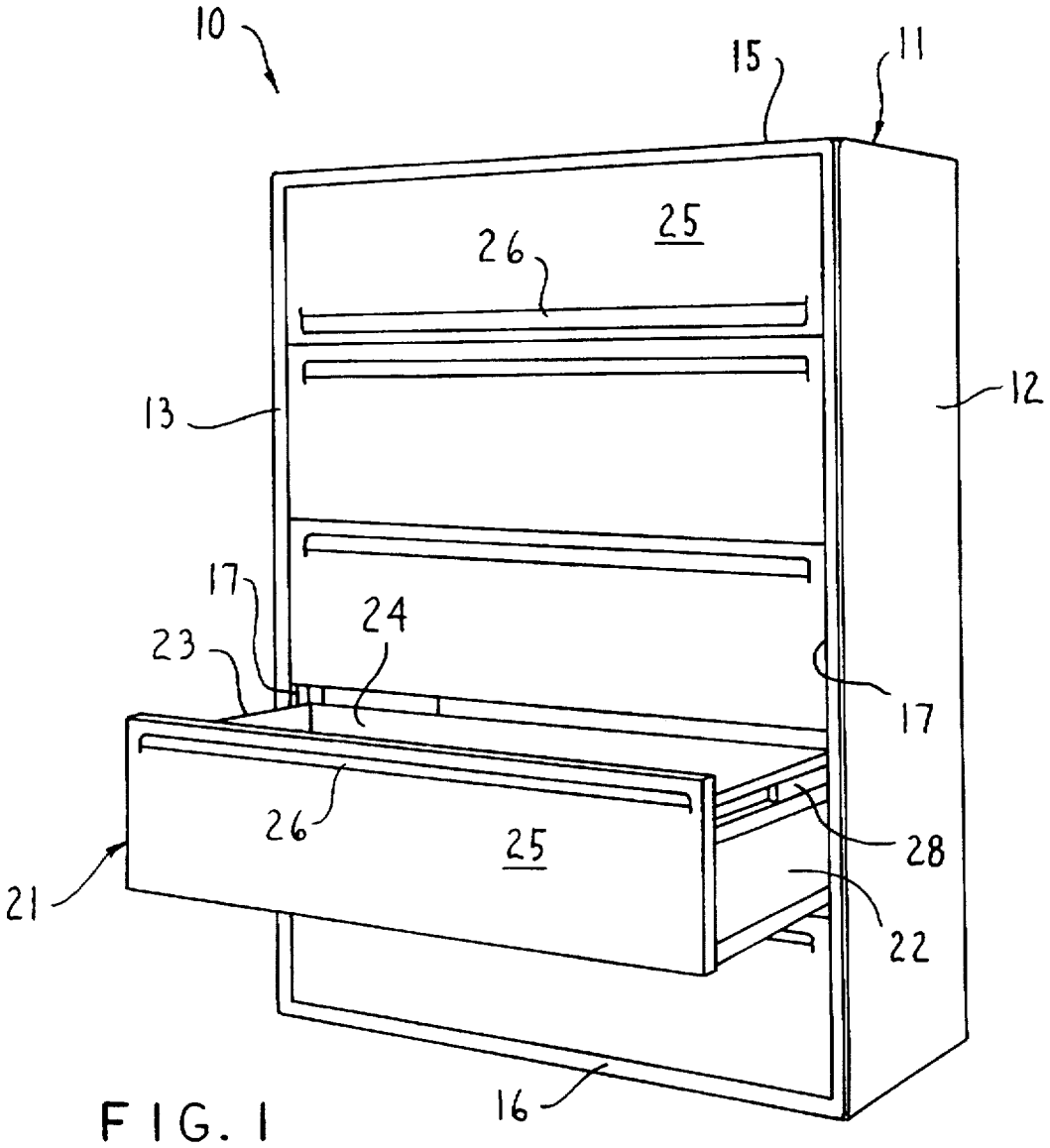
FIG. 1 is a perspective view of a storage cabinet with slidably mounted drawers extendible from the storage cabinet.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system or unit and designated parts thereof. Said terminology will include the words specifically mentioned, derivatives thereof, and words of similar import.

DETAILED DESCRIPTION

Figure 2:
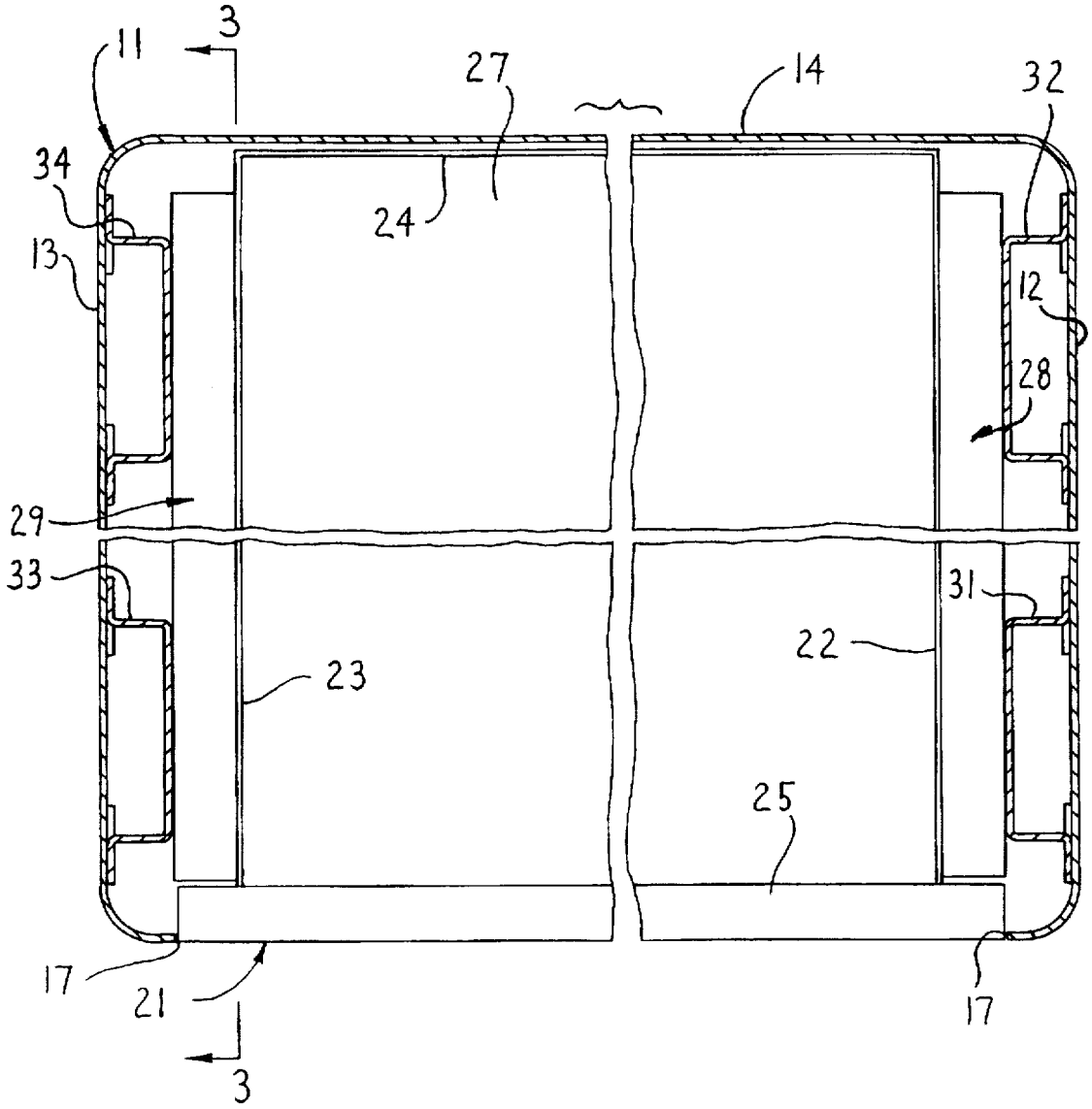
FIG. 2 is a sectional view through the storage cabinet looking downwardly into one of the slidably mounted drawers.

Referring to FIGS. 1 and 2, there is illustrated an upright drawer type storage unit 10 having a generally hollow box-like housing or cabinet 11. The box-like cabinet 11 has a right upright side wall 12, a left upright side wall 13, a back wall 14, a top wall 15, and a bottom wall 16. Each wall of the cabinet 11 is fixedly joined to the adjacent wall by conventional techniques, for example welding, interior brackets, etc. The cabinet has a front access opening 17.

Slidable drawers 21 are received in the cabinet 11 through the front opening 17. The drawers also have a box-like configuration usually with an open top and interior defined by an upright right end wall 22, an upright left end wall 23, an upright back wall 24, a front panel or wall 25, and a bottom wall 27. The front panel 25 is generally flush with the front edges of the right and left side walls 12, 13 of the cabinet 11 when the respective drawer is in a closed position. The front panel 25 has a handle 26 provided on an outer surface thereof for gripping the drawer 25 when effecting a sliding thereof. The drawers 21 are mounted on telescopic drawer slides 28, 29. The telescopic drawer slides 28, 29 are secured between side walls 22, 23 of the drawers 21 and the respective side walls 12, 13 of cabinet 11. The drawer slides 28, 29 are adapted to allow a drawer 21 to extend forwardly from the front opening 17 of the cabinet 11 to allow access to the interior of the drawers through the open top thereof.

A first pair of front and rear vertically elongate mounting rails 31, 32 are attached to the right upright side wall 12. A second pair of front and rear vertically elongate mounting rails 33, 34 are attached to the left upright side wall 13. Each pair of mounting rails 31, 32 and 33, 34 secure a respective telescopic drawer slide 28, 29 to the adjacent side wall 12, 13.

Each mounting rail 31–34 is, in the present invention, preferably identical in structure. Each of the mounting rails 31–34 has a U-shaped cross-sectional configuration (FIGS. 4–6) with a base wall or web 36, right side leg 37, and left side leg 38 (FIG. 5). A flange 39 is positioned at the end of each side leg 37, 38 distal the base 36. The flanges 39 are coplanar and are configured to engage a side wall 12, 13 of the cabinet 11 to secure the rail 31–34 to the cabinet housing 11, for example by welding. The rails 31–34 are each symmetrical about a central vertical plane 41 which extends perpendicular to the base 36 and contains the longitudinal central axis of the rail.

The mounting rails 31–34 are configured to mount thereon different size drawers as utilized in drawer-type storage units 10 by having a plurality of support openings 42 and slots 47 formed therein.

The support openings 42 are formed through the base wall 36 and are positioned in vertically spaced relation along the elongate length of the rail centered about the central plane 41. A cantilevered prong or projection 43 extends upwardly from the lower surface of the opening 42. The upper free end of the prong 43 is positioned at approximately the vertical midpoint of the opening 42, whereby the opening 42 has a generally inverted U-shaped configuration.

Figure 3:
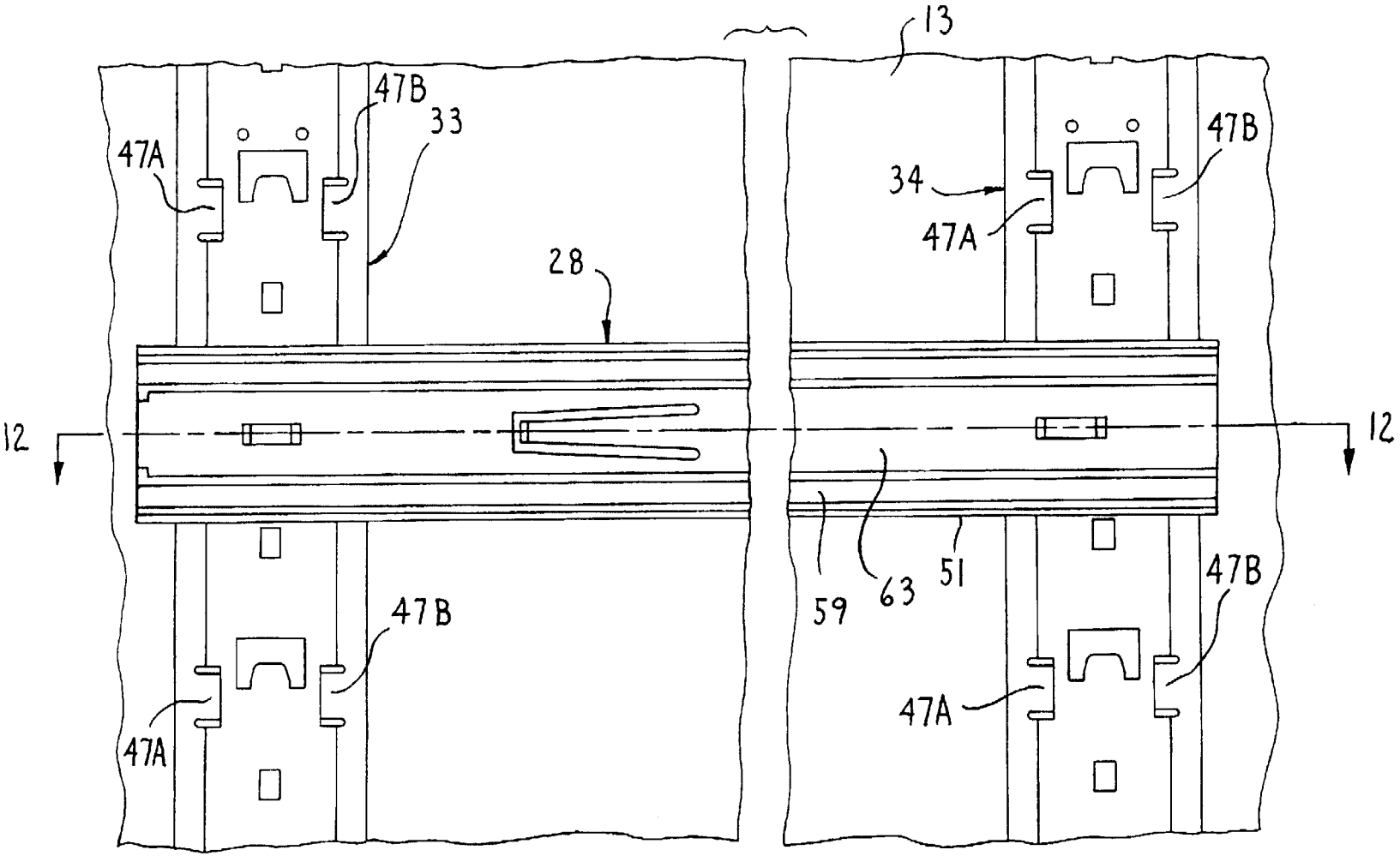
FIG. 3 is a view of a drawer slide mounted inside the storage cabinet on front and rear support members.

Each side leg 37, 38 of the mounting rail has a plurality of the slots or openings 47 formed therein in vertically spaced relation therealong. The slots 47 extend horizontally the full width of the side legs 37, 38 between the flanges 39 and the base wall 36, and also wrap around the joint or corner between the side legs 37, 38 and base wall 36 part way into the base wall 36. The slots 47 thus have, in horizontal cross section, a generally L-shape and are defined vertically between upper edges 48 and lower edges 49. Each mounting rail thus defines therein two vertically extending rows of said slots 47, which rows of slots are designated 47A and 47B (FIGS. 3 and 12) and are respectively directed forwardly and rearwardly of the cabinet. The rows of slots 47A and 47B are mirror images of one another about the central plane 41. The upper edges 48 of horizontally aligned slots 47A and 47B also are generally horizontally aligned with the upper edge of the prong 43 in the horizontally adjacent opening 42.

The openings 42 and adjacent slots 47 are adapted to receive the telescopic drawer slides therein. The openings 42 and slots 47 in all of the mounting rails 31–34 are positioned at the same vertical height within the cabinet 11, that is, they generally occupy the same horizontal plane. This insures a desired horizontal mounting of a drawer 21 within the drawer-type storage unit 10.

Figure 10:
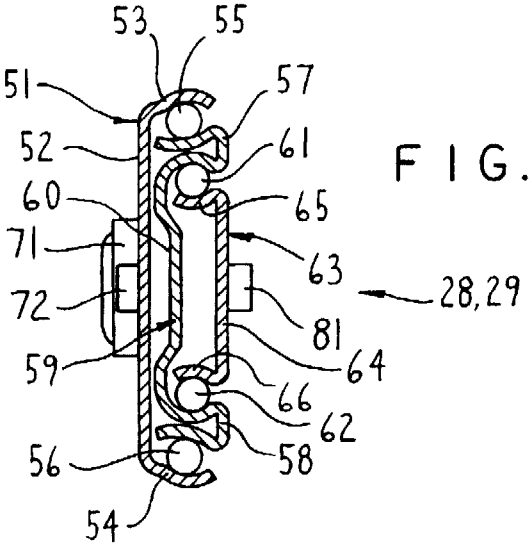
FIG. 10 is a cross sectional view of the drawer slide taken generally along line 10—10 in FIG. 7.

Each drawer 21 generally mounts thereon two drawer slides 28, 29, with each drawer slide 28, 29 being mounted on at least a pair of mounting rails 31, 32 or 33, 34 as associated with the respective cabinet side wall. The telescopic drawer slide has three longitudinally elongate rails supported for relative translational movement to provide a linear telescoping movement. As shown in FIG. 10, each drawer slide has an outer support rail 51, an intermediate rail 59 and an inner slide rail 63. These rails are configured to accommodate roller bearings or balls 55, 56, 61, 62 therebetween so that the inner slide rail 63 moves longitudinally (i.e. horizontally) with respect to the intermediate rail 59 on balls 61, 62, and the intermediate rail 59 moves longitudinally (i.e. horizontally) on the balls 55, 56 with respect to outer support rail 51.

The support rail 51 is of a shallow channel-shaped cross section and has an elongate base wall 52 with a generally transversely extending top edge wall 53 and a generally transversely extending bottom edge wall 54. The top and bottom edge walls 53, 54 are convex in cross section relative to the geometric center of the support rail 51 so as to receive balls 55, 56 therein.

The intermediate rail 59 is also of a shallow channel-shaped cross section which is nested within the outer rail 51 between the rollers 55 and 56. The intermediate rail 56 has an elongate base wall 60 provided with traversely projecting top and bottom edge walls 57, 58, respectively. Each edge wall 57, 58 is of a generally U-shaped construction and includes an outer wall part engaged with the balls 55, 56, and an inner wall part engaged with the balls 61, 62. As shown in FIG. 10, the outer wall parts of top and bottom edges 57, 58 have a convex outer surface relative to the geometric center of the drawer slide assembly 28, 29 for supportive engagement with the balls 55, 56. The inner wall parts of the top and bottom edges 57, 58 have a concave inner surface with respect to the geometric center of the drawer slide assembly to supportively engage the balls 61, 62. Thus, the channel-like configuration of the top and bottom edges 57, 58 allow the intermediate rail to secure the respective balls 55, 56 and 61, 62 thereon to allow translational linear movement between the rails 51, 59 and 63.

The inner slide rail 63 also has a shallow channel-shaped cross section defined by an elongate base wall 64 provided with transversely projecting top and bottom legs or edge walls 65, 66 respectively. The legs 65, 66 of the channel-shaped slide rail 63 are adapted to receive the balls 61, 62 thereon. The top and bottom edge legs 65, 66 are convex in shape with respect to the geometric center of the drawer slide assembly 28, 29. Thus, the top edge leg 65 secures the balls 61 between the inner slide rail 63 and the top edge 57 of intermediate rail 59. Similarly, the bottom edge leg 66 secures the balls 62 between the inner slide rail 63 and the bottom edge 58 of the intermediate rail 59.

Figure 8:
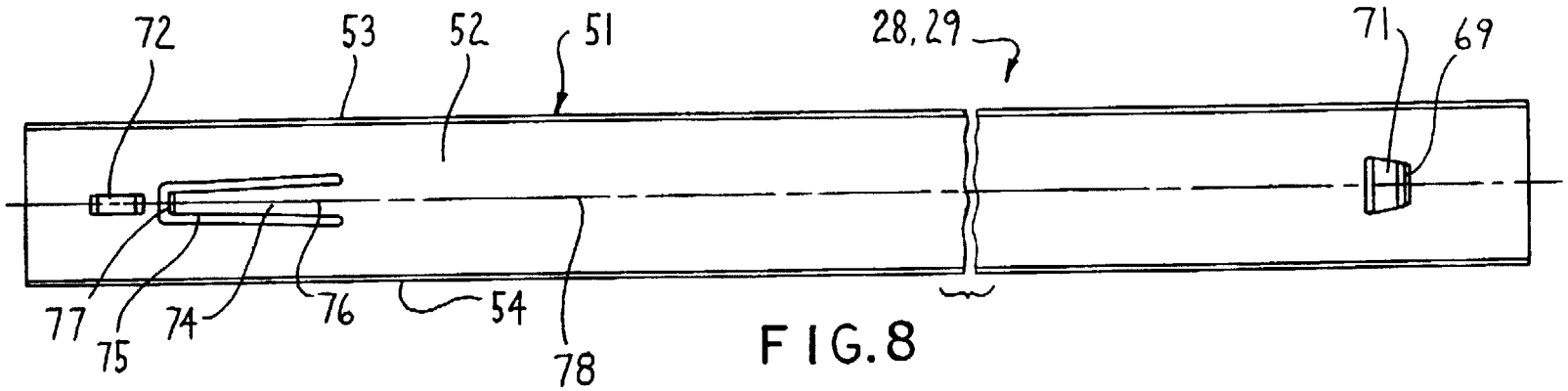
FIG. 8 is an outer side view of a support rail.
Figure 7:
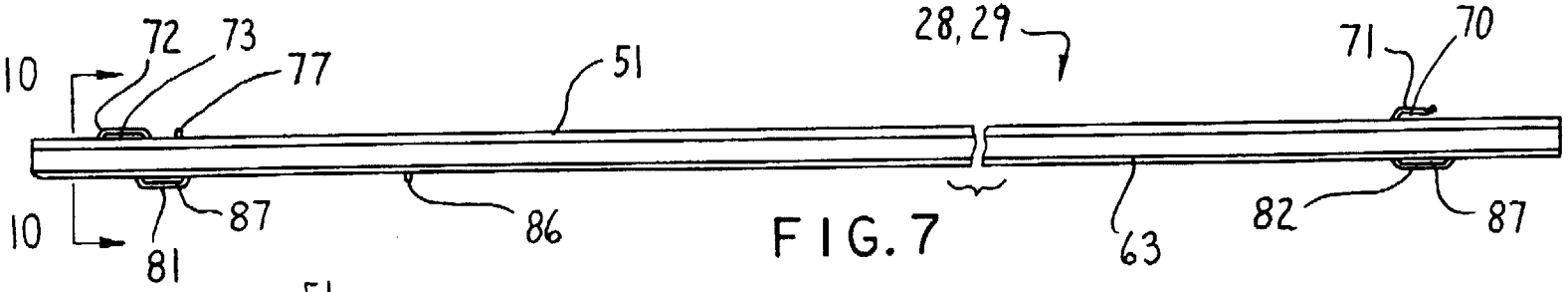
FIG. 7 is a top view of the drawer slide.
Figure 9:
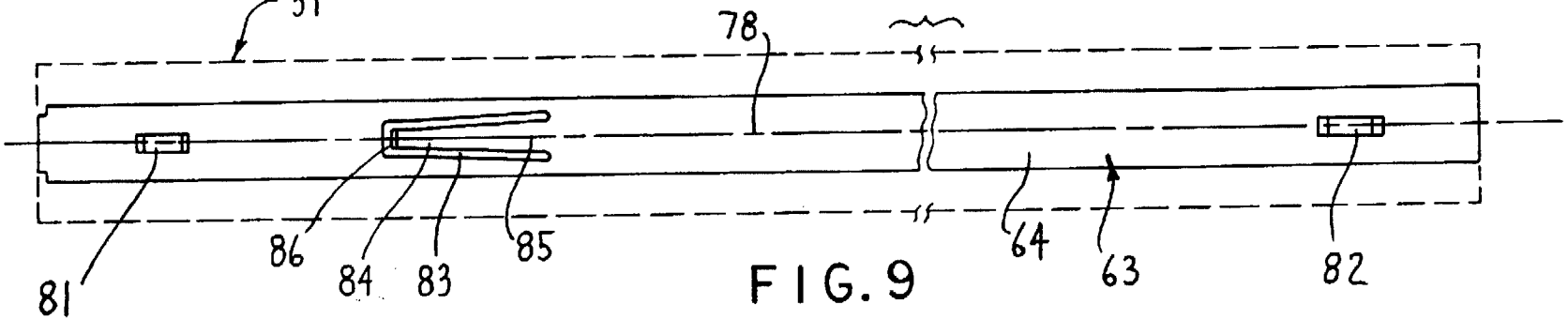
FIG. 9 is an inner side view of a slide rail with the support rail shown in broken line.

The elongate support rail 51 (FIGS. 7–9) is adapted to be stationarily secured on a pair of mounting rails, such as the pair 31–32 or 33–34. For this purpose, the support rail 51 has a resilient rearwardly-projecting cantilevered tongue or projection 71 provided thereon adjacent the rearward end thereof. The tongue 71 is stamped out of the base wall 52 of the support rail 51 so as to be displaced outwardly from the outer surface of the base wall 52, thereby defining an opening or slot 70 between the tongue 71 and the base wall 52. The tongue 71 is positioned to align with one slot 47 in a rear mounting rail when the drawer slide is installed.

The support rail 51 also has a U-shaped bracket or loop 72 positioned on the same side of the support rail as the cantilevered tongue 71. Bracket 72, however, is positioned adjacent the front end of the support rail 51. The bracket 72 is displaced outwardly from the outer surface of the base wall 52 and cooperate there with so as to define a vertically extending opening 73 therebetween. The bracket is positioned to align with one of the openings 42 in a front mounting rail, and the prong 43 inserted into the opening 73, when the drawer slide is installed.

The support rail 51, adjacent but rearwardly of the bracket 72, is provided with a cantilevered spring latch 74. The latch 74 is integral with the support rail 51 and is stamped out of the base wall 52 of the support rail 51. As shown, the latch 74 is defined by a generally U-shaped slit 75 stamped into the base wall 52 of the support rail 51 to provide a longitudinally elongate cantilevered finger which defines the latch 74. A rear end 76 of the latch 74 is integral with the support rail 51. A transversely extending locking tab 77 is formed on the free end of the latch 74 distal the integral end 76. The locking tab 77 projects transversely outwardly from the outer surface of the support rail 51 generally the same distance as the bracket 72. The locking tab 77 is integral with the free end of the latch 74, as by being bent outwardly therefrom.

The drawer slide 28, 29 has a central longitudinal axis 78 which extends substantially horizontally, and the support rail 51 is vertically symmetrical about the axis 78. A horizontal plane contains the axis 78 thus centrally passes through the tongue 71, bracket 72 and latch 74.

The slide rail 63 has a front bracket or loop 81 positioned adjacent the front end of the slide rail 63, and also has a rear bracket or loop 82 positioned adjacent the rear end thereof. Each bracket 81 and 82 is constructed similar to bracket 72 in that it is displaced inwardly from the inner surface of the base wall 64 so that each loop 81, 82 cooperates with the inner surface of base wall 64 to define a vertical opening 87 therebetween. The brackets 81 and 82 are also vertically symmetrically positioned relative to the central longitudinal axis 78.

The slide rail 63 also has a longitudinally elongate, cantilevered, resilient latch 84 formed in the base wall 64 thereof. The latch 84 is defined by an elongate cantilevered finger created by a U-shaped slit 83 which is stamped in the base wall 64. A rear end 85 of the latch 84 is integral with the slide rail 63. A locking tab 86 is positioned on the free end of the elongate latch 84 distal the integral end 85. The locking tab 86 extends transversely inwardly (FIG. 7) relative to the base wall 64. In the preferred embodiment, the slide rail 63 is also vertically symmetrical about the central longitudinal axis 78, whereby a horizontal plane containing the axis 78 thus vertically bisects the front loop 81, the rear loop 82, and the elongate latch 84.

The drawer slides 28 and 29, due to the vertical symmetry about the central longitudinal axis 78, thus do not have predefined upper and lower edges, although they do have predefined front and rear ends. The drawer slides 28 and 29 are thus identical, and this facilitates the overall construction and assembly of the cabinet, as explained below.

Figure 12:
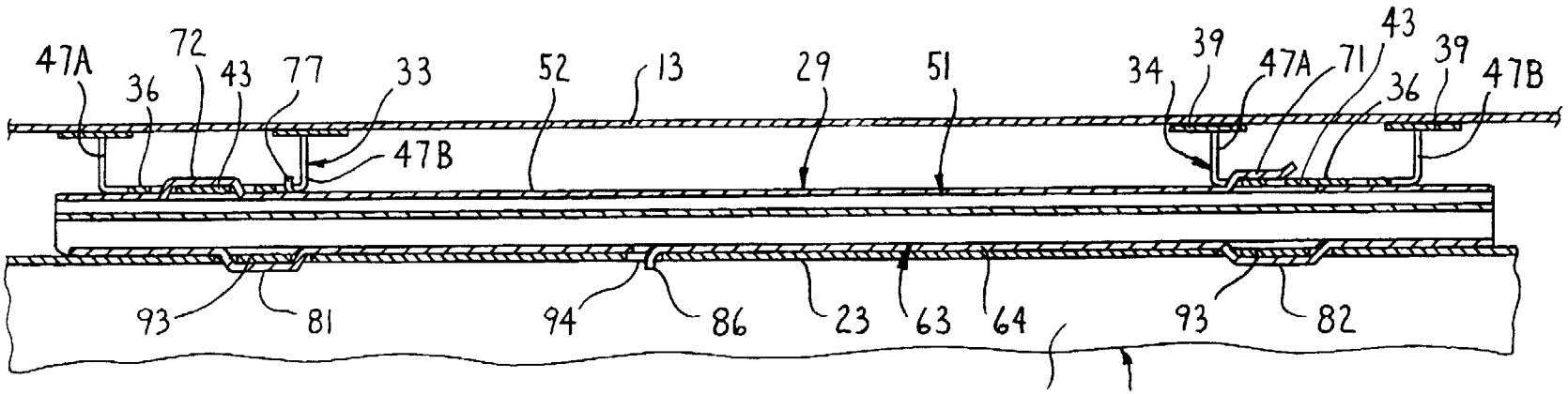
FIG. 12 is a cross sectional view of a drawer supported on the drawer slide mounted in the storage cabinet.

The drawer slide 29, as shown in FIG. 12, is installed on two mounting rails 33, 34 secured to one side wall 13 of the housing 11. The drawer slide 29 is positioned in the interior of the housing 11 and is oriented with its rearward end facing toward the back wall of the housing 11. The support rail 51 of drawer slide 29 faces outward toward side wall 13 of housing 11. The tongue 71 is positioned adjacent but forward of the rear mounting rail 34 so as to align with one of the slots 47A. The drawer slide is then moved rearwardly to cause the resilient cantilevered tongue 71 to enter the forward facing slot 47A in the rear mounting rail 34. The free end of the cantilevered tongue 71 is displaced away from the support rail 51 to receive the base wall 36 of the mounting rail 34 in the slot 70 as defined between the tongue 71 and support rail 51. The drawer slide 29 is now oriented with its rearward end engaged with and supported on the rear mounting rail 34.

The front end of drawer slide 29 is oriented slightly inclined with respect to the rearward end thereof so that the bracket 72 aligns with the upper portion of the adjacent opening 42 in front rail 33. The front end of slide 29 is then moved transversely toward the rail 33 to cause bracket 72 to be inserted into the upper part of opening 42. As bracket 72 is inserted into the opening 42, the locking tab 77 of the resilient cantilevered latch 74 contacts the base wall 36 of the front mounting rail 33 at a location directly above the upper edge 48 of the slot 47B. This contact between the tab 77 and base wall 36 resiliently deflects the latch 74 inwardly. The front end of the drawer slide 29 is now pivoted downwardly so that the prong 43 is received in the opening 73 between the bracket 72 and the base wall 52 of support rail 51. The front end of the drawer slide 29 is pivoted downward until the bracket 72 rests on the bottom edge of the opening 42. Simultaneously with the bracket 72 being pivoted downward in opening 42, the locking tab 77 is in downward sliding contact with the base wall 36 and passes downwardly of the top edge 48 of the rearward facing slot 47B in the front mounting rail 33. Once the locking tab 77 passes the top edge 48, the resilient force of the latch 74 snaps the locking tab 77 into the respective slot 47B. The locking tab 77 thus extends into the slot 47B and prevents an accidental disengagement of the prong 43 from the opening 73 by abutting the top edge 48. Thus a secure attachment of the drawer slide 29 to the mounting rails 33, 34 is assured.

A drawer slide 28, identical to the installed slide 29, is installed on the other side wall 12 of the housing 11. Drawer slide 28 can be oriented the same as drawer slide 29, that is, it is oriented with its rearward end facing the back wall 14 of the housing. If the drawer slide 28 has its support rail 51 facing the same side wall as drawer slide 29, it is easily corrected by simply rotating the drawer slide 180° about the central axis 78. Due to the symmetrical nature of the drawer slides 28, 29 about the longitudinal center line 78, rotating the drawer slide 28 180° about this center line 78 corrects its orientation for installation on the other side wall 12 of the housing 11. Drawer slide 28 is now installed in the same manner on mounting rails 31, 32 as described above for drawer slide 29. Thus, the drawer slides 28, 29 only have a front and rear orientation, and lack a specific left or right orientation.

Figure 11:
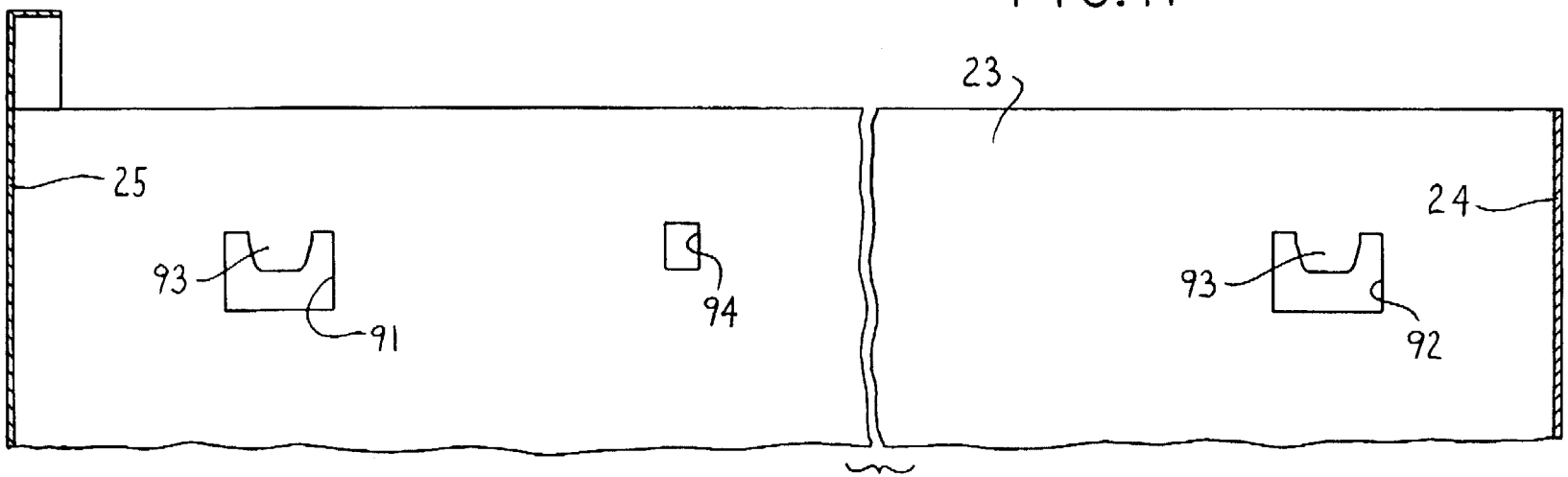
FIG. 11 is a side view of a left side wall of a drawer.

The drawer end walls 22, 23 each have a front opening 91 (FIG. 11) and a rear opening 92 therethrough. The openings 91, 92 each have a downwardly extending cantilevered prong 93 extending from the top toward the bottom thereof. The openings 91, 92 thus essentially have a U-shaped configuration with the prongs 93 centered on the top edge of the respective opening. The brackets 81, 82 of the slide rails 63 are designed to extend through the openings 91, 92.

An intermediate opening 94 extends through each of the drawer end walls 22, 23 and is positioned adjacent but rearwardly of the front opening 91. This opening 94 is disposed so that it aligns with the locking tab 86 of the slide rail 63 when the drawer 21 is secured on the slide rail 63.

The drawer 21 is secured on the slide rails 63 by aligning the front and rear brackets 81, 82 of the slide rail 63 with lower portions of the front and rear openings 91, 92 of the drawer 21 so that the brackets 81, 82 extend through the openings 91, 92. At this position, the tab 86 engages the drawer end wall 22 or 23 just above the opening 94 and causes the latch 84 to be resiliently deflected. The drawer is then lowered to cause the prongs 93 within the openings 91, 92 to be inserted into the openings 87 defined behind the brackets 81, 82. This also causes the latch tab 86 to align with the opening 94, whereupon the resilience of the elongate latch 84 forces the locking tab 86 into the intermediate opening 94. Thus, the drawer 21 rests with the prongs 93 extending behind the brackets 81, 82, and with the top edge of the openings 91, 92 resting on the top surface of the brackets 81, 82. The locking tab 86 snaps into the intermediate opening 94 and prevents the drawer from being lifted off the brackets 81, 82 of the slide rail 63, unless the locking tab 86 on the resilient latch 84 is displaced from the intermediate opening 94.

While the drawer slide of this invention has been illustrated in the drawings as being used on an upright lateral-type file as shown by FIG. 1, it will nevertheless be appreciated that the illustration of a lateral file is solely for convenience in illustration, and that the drawer slide of this invention is also equally applicable on numerous other types of drawer-type storage units. For example, the drawer slide of this invention is equally applicable on drawer-type storage units of the type commonly known as vertical files, as well as for use on drawer-type storage units of the type known as pedestals, the latter being drawer units which typically are positionable under a worksurface.

Further, it will also be appreciated that the cross sectional configuration of the rails 51, 59 and 63 as illustrated in FIG. 10 is solely for illustrative purposes and such cross sectional configurations can assume other conventional shapes while still providing for the desired linear longitudinal extension between the outer and inner support rails.

Although a particular preferred embodiment of the invention has been disclosed in detail for illustrative purposes, it will be recognized that variations or modification of the disclosed apparatus, including the rearrangement of parts, lie within the scope of the present invention.

The embodiments of the invention in which an exclusive property or privilege is claimed are defined as follows:

1. A drawer slide for a drawer-type storage unit having at least one drawer therein, comprising:

an elongate support rail adapted for releasable attachment to a side wall of a storage unit housing, said support rail having a channel-shaped configuration with top and bottom support rail edges extending from edges of a base wall;

said elongate support rail including a cantilevered elongate tongue extending outwardly from one longitudinally extending side surface of said support rail adjacent one end, a loop-like bracket extending outwardly from said one side surface adjacent the other end of said support rail, said loop-like bracket having a U-shaped member extending outwardly from the base wall to define an opening between said bracket and said one side surface which extends generally transverse to the elongate direction of said support rail for permitting the support rail and the bracket thereon to be moved downwardly onto a mounting structure of the storage unit, said bracket being longitudinally spaced from said tongue, a resilient latch provided on said one side surface and having a locking tab extending generally transverse of said one side surface, said latch being intermediate said tongue and said bracket and positioned closer to said bracket than said tongue, said tongue, said bracket and said latch being positioned along a central longitudinal axis of said support rail so that said support rail is vertically symmetrical about said central longitudinal axis;

an elongate intermediate rail having top and bottom intermediate rail edges;

an elongate slide rail adapted for releasable attachment to a drawer, said slide rail having a channel-shaped configuration with top and bottom slide rail edges;

a first set of rolling support elements engaged between said support rail top and bottom edges and said intermediate rail top and bottom edges for permitting relative translational movement between said support and intermediate rails; and a second set of rolling support elements engaged between said top and bottom intermediate rail edges and said top and bottom slide rail edges for permitting relative translational movement between said intermediate and slide rails.

2. A drawer slide for a drawer-type storage unit having at least one drawer therein, comprising:

an elongate support rail adapted for releasable attachment to a side wall of a storage unit housing, said support rail having a channel-shaped configuration with top and bottom support rail edges;

said elongate support rail including a cantilevered elongate tongue extending outwardly from one longitudinally extending side surface of said support rail adjacent one end, a loop-like bracket extending outwardly from said one side surface adjacent the other end of said support rail so as to define an opening between said bracket and said one side surface, said bracket being longitudinally spaced from said tongue, a resilient latch provided on said one side surface and having a locking tab extending generally transverse of said one side surface, said latch being intermediate said tongue and said bracket and positioned closer to said bracket than said tongue, said tongue, said bracket and said latch being positioned along a central longitudinal axis of said support rail so that said support rail is vertically symmetrical about said central longitudinal axis;

an elongate intermediate rail having top and bottom intermediate rail edges;

an elongate slide rail adapted for releasable attachment to a drawer, said slide rail having a channel-shaped configuration with top and bottom slide rail edges, said elongate slide rail includes first and second slide rail brackets each defining an opening between a respective said slide rail bracket and a surface of said slide rail, and a resilient elongate slide rail latch having a tab extending beyond said surface of said slide rail away from said support rail, said first and second slide rail brackets and said slide rail latch being positioned along a central longitudinal axis of said slide rail so that said slide rail is vertically symmetrical about said central longitudinal axis of said slide rail:

a first set of rolling support elements engaged between said support rail top and bottom edges and said intermediate rail top and bottom edges for permitting relative translational movement between said support and intermediate rails; and a second set of rolling support elements engaged between said top and bottom intermediate rail edges and said top and bottom slide rail edges for permitting relative translational movement between said intermediate and slide rails.

3. The drawer slide according to claim 1, wherein said support rail latch is defined by a slit stamped into said support rail, and wherein said tab is defined by a portion of said latch extending transverse to said support rail.

4. A drawer-type storage cabinet comprising:

an upright housing including first and second upright side walls, a back wall extending between rear edges of said first and second side walls, a top wall extending between top edges of said side walls and said backwall, and a vertically enlarged access opening defined in a front side of said housing between front edges of said first and second side walls;

substantially identical front and rear, vertically elongate and substantially parallel, mounting rails fixedly secured to an inner surface of each of said first and second side walls;

each said mounting rail having a generally U-shaped cross section including first and second legs and a base extending therebetween, a plurality of spaced first slots vertically aligned in said first leg, a plurality of spaced second slots vertically aligned in said second leg, said plurality of first slots being mirror images of said plurality of second slots relative to a central longitudinal plane of said mounting rail, said central longitudinal plane being generally perpendicular to said base, and a plurality of spaced mounting openings vertically aligned in said base and each having an upwardly cantilevered prong therein positioned along said central longitudinal plane;

a pair of identical, longitudinally elongate drawer slides each including an elongate support rail, an elongate intermediate rail, an elongate slide rail, and means for telescopically extending each drawer slide by longitudinally extending said intermediate rail with respect to said support rail and longitudinally extending said slide rail with respect to said intermediate rail, each said drawer slide being vertically mirror imaged about a central longitudinal axis thereof so that each said drawer slide is mountable along either of said first and second side walls;

said support rail having a cantilevered, longitudinally extending tongue provided thereon and engaged in said first slot in one of said front and rear mounting rails;

said support rail having a loop-like support bracket provided thereon in longitudinally spaced relation from said tongue, said support bracket being received in one of said mounting openings in the other of said front and rear mounting rails with said prong being engaged within said support bracket;

said support rail also having a resilient latch positioned adjacent said support bracket for preventing disengagement of said support rail from said other mounting rail, said latch being engaged with one of said second slots in said other mounting rail; and a horizontally movable drawer extending between and being releasably engaged with said slide rails of said pair of drawer slides.

5. The storage cabinet according to claim 4, wherein:

each said slide rail includes first and second slide rail brackets each defining a vertical extending opening between the respective said slide rail bracket and a side surface of said slide rail, and a resilient slide rail latch including a transversely extending tab;

said movable drawer including a pair of end walls, each said end wall including a first drawer opening to receive said first slide rail bracket therein, a second drawer opening to receive said second slide rail bracket therein, said first and second drawer openings each having downwardly cantilevered prongs receivable in respective said openings as defined between said first and second slide rail brackets and said surface of said slide rail, and a third drawer opening positioned intermediate said first and second drawer openings to receive said tab of said slide rail latch therein.

6. The storage cabinet according to claim 4, wherein one said rear mounting rail is respectively fixedly secured to each of said first and second side walls adjacent said back wall, wherein one said front mounting rail is respectively fixedly secured to each of said first and second side walls adjacent said access opening in said housing, wherein said first slots face toward said access opening and said second slots face toward said back wall, wherein each said tongue is respectively received in one said first slot in said one rear mounting rail adjacent said back wall, wherein one said prong in one said opening in said front rail is respectively engaged by one said support bracket, and wherein one said latch respectively engages one said second slot in said front mounting rail.

7. The storage cabinet according to claim 4, wherein said first and second slots extend part way into said base of said mounting rail.

8. The storage cabinet according to claim 4, wherein said support rail latch is defined by a U-shaped slit formed in said support rail, and wherein said tab is defined by a bent tip portion of said latch extending transverse to said support rail.

9. A drawer-type storage unit, comprising:

a box-like cabinet having a front access opening, two sidewalls, and a rear wall, front and rear mounting rails fixedly secured to each of said two sidewalls in said cabinet and extending vertically therealong with said front mounting rail being adjacent said front access opening and said rear mounting rail being adjacent said rear wall, said front and rear mounting rails each having a generally U-shaped configuration including first and second legs and a web between said first and second legs, said web extending parallel to said sidewall and laterally spaced inwardly therefrom, said first leg facing said front access opening and said second leg facing said rear wall, a plurality of first slots vertically spaced along said first leg, a plurality of second slots vertically spaced along said second leg, and a plurality of rail openings vertically spaced along said web, each rail opening having a respective upwardly projecting cantilevered prong therein;

at least two horizontally elongate drawer slides each mountable on a respective pair of said front and rear mounting rails with two of said drawer slides being mounted laterally-spaced along opposing sidewalls, each said drawer slide being vertically symmetrical about a central longitudinal plane containing a central longitudinal axis thereof, each said drawer slide including an elongate support rail, an elongate intermediate rail, an elongate slide rail, a first translational movement means slidably connected between said intermediate rail and said support rail for providing translational movement of said intermediate rail with respect to said support rail, and a second translational movement means slidably connected between said slide rail and said intermediate rail for providing translational movement of said slide rail with respect to said intermediate rail, said support rail including a rearwardly cantilevered tongue means for securing one end of said support rail in one said first slot in said rear mounting rail in response to rearward longitudinal movement of said support rail, a loop-like bracket means for securing the other end of said support rail in one said rail opening in said front rail by engaging said prong in response to a downward pivoting movement of said support rail, and a latch means adapted to be received in one said second slot in said front rail in simultaneous response to said pivoting movement of said support rail for releasably latching said support rail to said front rail; and a box-like drawer receivable in said cabinet through said front access opening, and a drawer support means for releasably securing said drawer to said slide rail.

10. The drawer-type storage unit according to claim 9, wherein said drawer support means includes first second and third drawer openings in opposed end walls of said drawer, said first and second openings have a downwardly projecting prong therein, a pair of longitudinally spaced loop-like brackets on each said slide rail adapted to be received in said first and second openings and respectively receive said prongs, and a latch means receivable in said third opening for releasably securing said drawer to said slide rail for preventing accidental disengagement of said drawer from said slide rail.

* * * * *